US006158563A

United States Patent [19]

Welfonder et al.

[11] Patent Number: 6,158,563

[45] Date of Patent: Dec. 12, 2000

[54] WINDING MECHANISM

[75] Inventors: Konrad Welfonder; Lars Koop, both of Bremerhaven, Germany

[73] Assignee: Hunter Douglas International N.V., Netherlands Antilles

[21] Appl. No.: 09/353,889

[22] Filed: Jul. 15, 1999

[30] Foreign Application Priority Data

Jul. 15, 1998 [EP] European Pat. Off. ..... 98305635

[51] Int. Cl.[7] ..... F16D 67/02

[52] U.S. Cl. ..... 192/223.3; 192/128; 192/223.4; 160/307; 160/291; 160/298; 160/319; 242/394.1; 242/396.5; 242/396.6

[58] Field of Search ..... 160/291, 292, 160/298, 307, 319, 321; 192/223, 223.4, 12 B, 223.3; 242/396.5, 396.6, 394.1

[56] References Cited

U.S. PATENT DOCUMENTS

| | | | |
|---|---|---|---|
| 3,146,868 | 9/1964 | Lang | 192/223 |
| 4,372,432 | 2/1983 | Waine et al. . | |
| 4,427,050 | 1/1984 | Toppen . | |
| 4,534,396 | 8/1985 | Jung . | |
| 4,595,209 | 6/1986 | Tsai | 192/12 B |
| 5,375,643 | 12/1994 | Rude . | |

FOREIGN PATENT DOCUMENTS

| | | | |
|---|---|---|---|
| 0474134 | 3/1992 | European Pat. Off. . | |
| 0481688 | 4/1992 | European Pat. Off. . | |
| 0627542 | 12/1994 | European Pat. Off. . | |
| 0717166 | 6/1996 | European Pat. Off. . | |
| 3344 | of 1882 | United Kingdom | 160/292 |
| WO 91/03619 | 3/1991 | WIPO . | |

*Primary Examiner*—Blair M. Johnson
*Attorney, Agent, or Firm*—Dorsey & Whitney LLP

[57] ABSTRACT

A winding mechanism for an architectural covering such as a blind or shade in which a fixed shaft 10,110 is surrounded by an inner sleeve 16,116 and an outer sleeve 22,122. A one way clutch 20,32 is provided between the inner sleeve and the fixed shaft, and a cord 42,142 is wrapped around the outer surface 40,140 of the inner sleeve, and is connected at one end 44,144 to the outer sleeve 22,122 and at the other end 46,146 to drive member 12, 112 such as a bead pulley. The weight of the blind or shade tending to rotate the outer sleeve in one direction of rotation will tighten the helically wound cord 42,142 onto the outer surface 40, 140 of the inner sleeve locking it thereto and preventing, via the one way clutch 28,72, rotation of the outer sleeve until such time as the drive member 12,112 is rotated in one direction or the other to raise or lower the blind or shade.

16 Claims, 4 Drawing Sheets

WINDING MECHANISM

BACKGROUND OF THE INVENTION

1. Field of the Invention

This invention relates to a winding mechanism for controlling the retraction and deployment of an architectural covering, especially a covering of an architectural opening, such as a window blind or shade. This invention particularly relates to a winding mechanism useful for controlling the winding and unwinding of the covering, itself, about a tubular roller, or for controlling the winding and unwinding of lift cords and/or tapes of the covering about a spool or the like.

2. Description of the Related Art

Winding mechanisms for retracting or raising window shades and blinds have often used a spring motor to bias the shades and blinds towards the retracted position. Other mechanisms use bead chains or their like for manually controlling the lowering and retraction. To hold a shade or blinds in its deployed or lowered position, these mechanisms have also been provided with a locking system. Such locking systems are disclosed in EP 0474134 (B1); WO 91/03619 and U.S. Pat. No. 4,534,396. Conventionally, the locking system is involved in an arrangement in which, when the shade or blind has been pulled down or unwound, the shade or blind has been locked in the lowered position.

SUMMARY OF THE INVENTION

According to this invention, there is provided a winding mechanism for an architectural covering such as a blind or shade, said mechanism including a fixed, stationary shaft having an axis, an inner sleeve mounted for rotation relative to said stationary shaft about said axis, a one way clutch permitting relative rotation between said inner sleeve and said shaft about said axis in one rotation sense, but preventing relative rotation in the opposite sense, an outer sleeve mounted for rotation relative to said inner sleeve, said outer sleeve having a substantially cylindrical inner wall, and said inner sleeve having a substantially cylindrical outer surface, radially spaced from and extending within said inner wall by a given radial distance, a drive member rotatable relative to said stationary shaft, and a cord secured at a first end to said drive member, said cord being helically wrapped about said outer surface of said inner sleeve, within the outer sleeve, the second end of said cord being secured to said outer sleeve, the arrangement being such that the weight of the blind or shade which in use tends to rotate the outer sleeve in said one rotational sense, thereby causing the cord to tighten on the outer surface of the inner sleeve, and locking said outer sleeve to said inner sleeve, and preventing rotation of said outer sleeve in said opposite rotational sense.

The use of the cord wrapped around the outer surface of the inner member to act as a one way clutch or brake, to prevent unwanted lowering of the blind or shade, is very simple and inexpensive, yet is fully effective.

One known alternative is a coil spring wrapped about a plastic member such as disclosed in U.S. Pat. No. 4,372,432 or U.S. Pat. No. 5,375,643. While this is less expensive than other earlier systems, the tolerancing of the dimensions of the spring and of the plastic member are not such as to provide a satisfactory arrangement. No such tolerancing problems are encountered with the structure of the invention.

Preferably, the one way clutch comprises a clutch member surrounding said fixed shaft and having a mating surface for mating with an end of said inner sleeve to prevent relative rotation therebetween, the clutch member being mounted on said fixed shaft with a helical mount such that rotation of the clutch member in the winding direction causes axial movement of the clutch member to disengage said mating surface from the end of said inner sleeve.

In this way, the mechanism does not require ratchet teeth to move over one another during the winding operation. This avoids the noise produced by this process and prevents wear of the teeth.

Preferably, the clutch member includes at least one axially extending resilient tongue with a generally conical end surface and wherein the outer sleeve includes an inwardly facing generally conical surface against which said end surface abuts such that, when the clutch member is axially moved to disengage said mating surface the end surface is moved axially and radially inwardly by the conical surface against the resilient resistance of the tongue so as to form a frictional force therebetween, the frictional force enabling the outer sleeve to rotate the clutch member.

In this way, during the unwinding operation, the outer sleeve may rotate freely relative to the clutch member, but during the winding operation, the frictional force causes the outer sleeve to maintain the clutch member at its disengaged position relative to the inner sleeve.

DETAILED DESCRIPTION OF THE PREFERRED EMBODIMENTS

Figure 1:
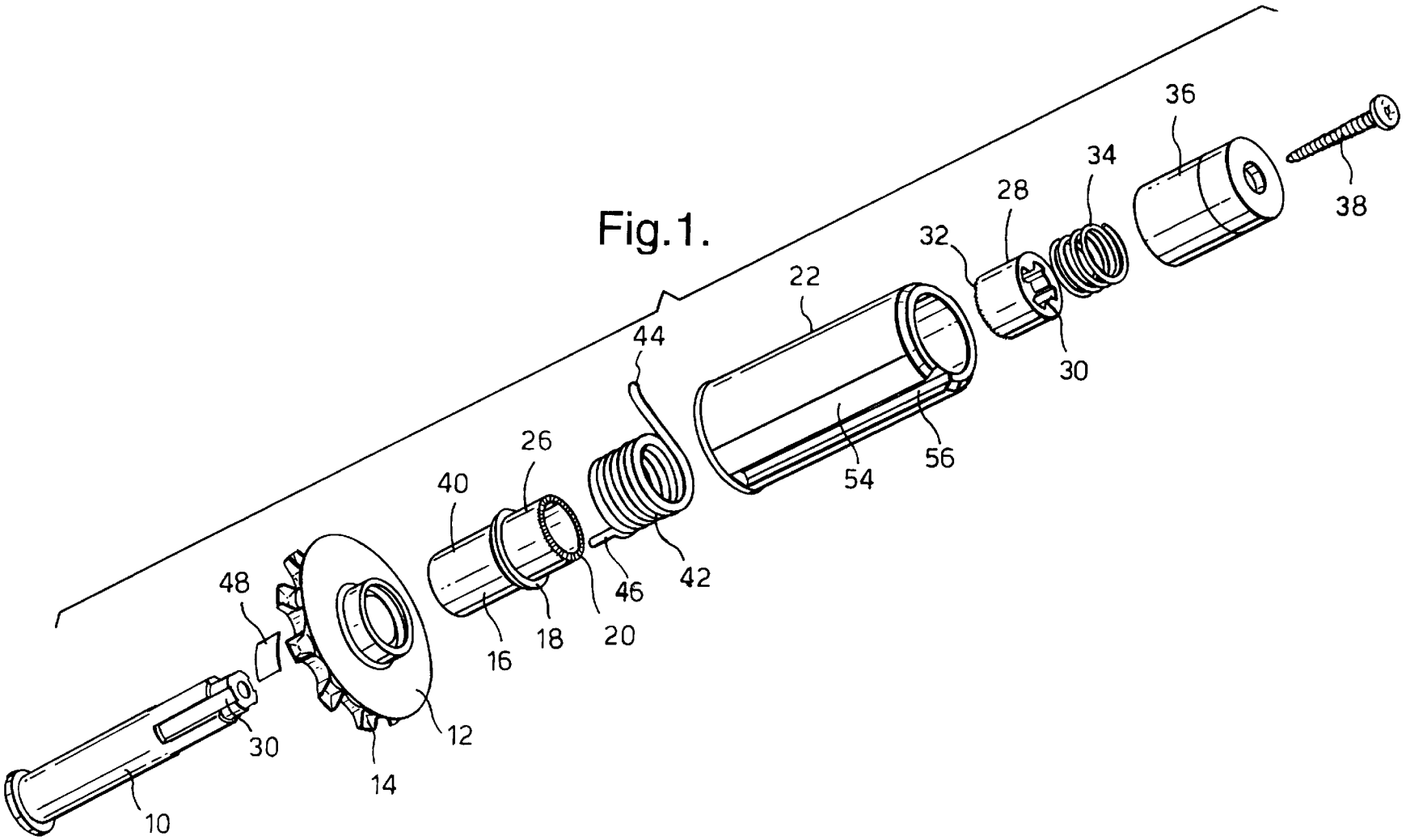
FIG. 1 is an exploded perspective view of one embodiment of a winding and unwinding mechanism according to the invention.
Figure 2:
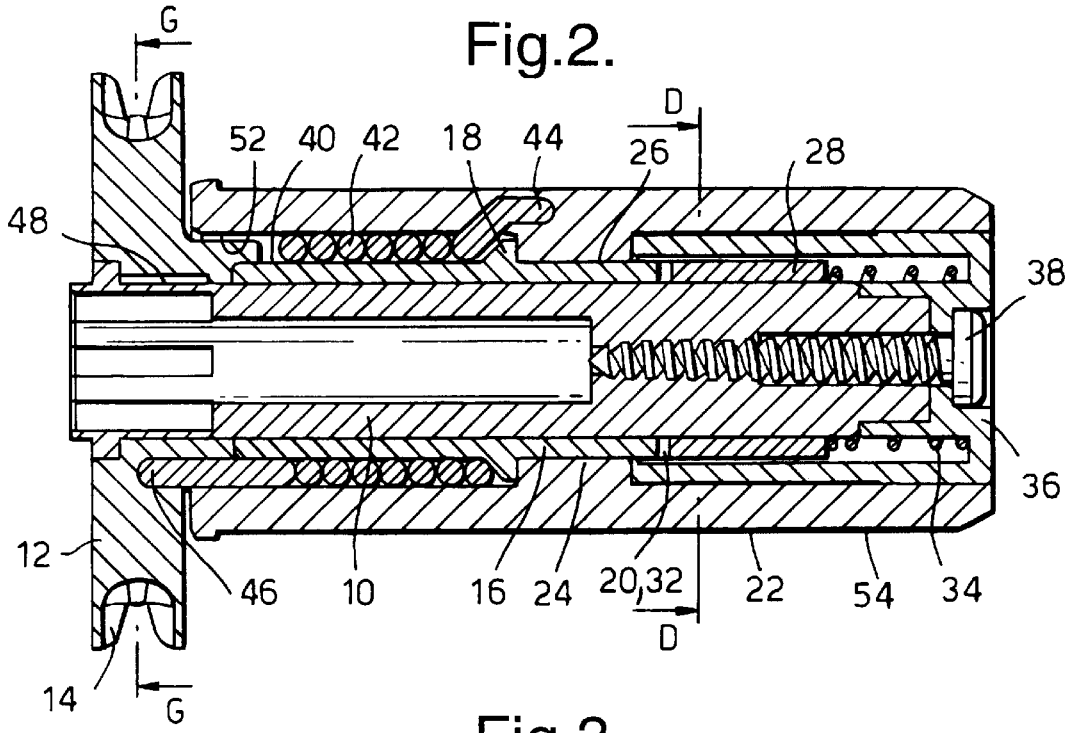
FIG. 2 is a longitudinal cross-section of the assembled mechanism of FIG. 1.
Figure 3:
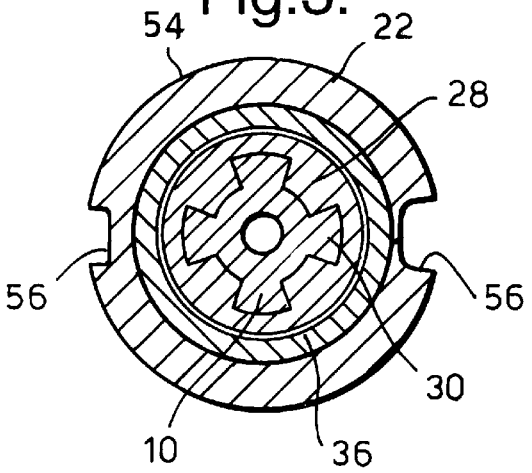
FIG. 3 is a cross-section taken along the line D—D of FIG. 2.
Figure 4:
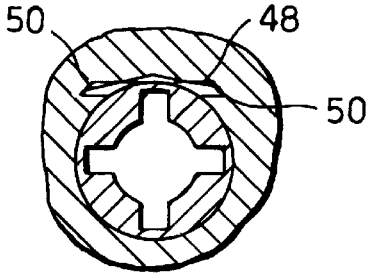
FIG. 4 is a partial cross-section taken along the line G—G of FIG. 2.

Referring to FIGS. 1 to 4, the winding and unwinding mechanism illustrated includes a fixed shaft 10 which can be mounted by means (not shown) on a head rail or the like of a blind or shade. Rotatably mounted on the fixed shaft 10 is a conventional drive member or wheel 12 which is in the form of a pulley and can, as shown, have an exterior rim 14 shaped to receive a bead chain, or may be a simple pulley, to receive a cord.

Also rotatably mounted on the fixed shaft 10 is an inner sleeve 16 having slightly off-set to the right from its centre, an exterior collar 18, and at its right end ratchet teeth 20.

An outer sleeve 22 surrounds the inner sleeve 16, and a radially inwardly projecting bearing portion 24 of the outer sleeve engages an outer surface portion 26 of the inner sleeve to the right of the collar 18.

Further surrounding the fixed shaft 10 is a clutch member 28, which is axially slidable on the shaft 10 and is prevented from rotation relative thereto by keys 30 (FIG. 3), the clutch member 28 having further ratchet teeth 32, engageable with the ratchet teeth 20. The clutch member 28 is urged to the left by a spring 34, which abuts an end cap 36, which is held in place by a screw 38 engaged in an aperture in the fixed shaft 10.

Wound helically around the outer surface 40 of the inner sleeve 16 is a cord 42, a first hand end 44 of which is secured to the outer sleeve 22, and a second left hand end 46 of which is secured to the drive wheel 12. The means of securing the first and second ends 44,46 of the cord 42 can take any suitable format, e.g. grub screws, adhesive, knots, clamps or any other form of cord retaining arrangement.

A friction brake pad, preferably in the form of leaf spring 48 has its ends engaged in recesses 50 formed in the drive wheel 12. The friction brake pad 48 engages the outer surface of the fixed shaft 10.

The inner surface 52 of the outer sleeve 22 is radially spaced from the outer surface 40 of the inner sleeve 16, by an amount slightly greater than the thickness of the cord 42.

The outer surface 54 of the outer sleeve 22 can itself provide a surface upon which a lift cord may be wrapped, or it can be keyed to a roll upon which the lift cord, or the blind or shade itself may be wound. It will be noted that FIG. 1 illustrates a key way 56 on the exterior surface 54 of the outer sleeve 22 which can assist in this connection.

In use, with the weight of the blind causing the outer sleeve 22 to rotate in a counter clock-wise sense as viewed in FIG. 1, this will cause the winding of the cord 42 to tighten on the outer surface 40 of the inner sleeve 16. With the second, left hand end 46 of the cord 42 secured to the drive wheel 12, and with drive wheel 12 being held by the brake pad on the stationary shaft 10, this will ensure that the windings of the cord are urged firmly against the outer surface 40.

Thus, the inner sleeve 16, in this direction of rotation of the outer sleeve, is locked to the stationary shaft by means of the one way ratchet teeth 20,32, on the clutch member 28, and the inner sleeve 16. Thus, the outer sleeve 22 is inhibited from turning with respect to the stationary shaft if subjected to the weight of the blind in this direction of rotation.

When, however, the drive wheel 12 is rotated in the same direction, e.g. by the bead chain, then the cord end 44 is no longer held with respect to the fixed shaft 10. The windings of the cord 42 are thus loosened from the internal sleeve 16, this enabling the blind material, or the lift cord where appropriate, to descend by its own weight, as long as the drive wheel 12 is rotated in this direction.

When the drive wheel 12 is rotated in the opposite direction, e.g. by the bead chain, then the cord windings around the inner sleeve 16 become tighter and engage the inner sleeve 16 for rotation in the same direction. Now the one way clutch including the ratchet teeth 20,32 allow the inner sleeve 16 to rotate with the cord windings by axial movement of the ratchet element against the spring 34.

The braking arrangement described, it will be appreciated, prevents the blind from lowering beyond its adjusted position by locking the outer sleeve 22 by means of the cord 42 to the inner sleeve 16, which is locked to the fixed shaft 10 through the one way ratchet teeth 20,32. At the same time it allows the blind to be raised and lowered by rotation of the drive wheel 12 in the relevant direction.

The one way ratchet clutch as shown provided by the teeth 20,32 could be replaced by any suitable one way clutch not using ratchet teeth. It is contemplated in fact that a one way clutch arrangement similar to that provided by the cord 42 engaging on the outer surface 40 of the inner sleeve 16 could itself be provided between the inner sleeve and the fixed drive shaft 10.

The structure of the brake or one way clutch system provided by the cord 42 is very reliable and inexpensive.

The number of windings of the cord around the outer surface 40 of the inner sleeve 16 predetermines the braking force required from the friction brake pad 48. The greater the number of cord windings, the lesser the required braking force will be. It has been found that with about seven windings the required brake force will be almost zero. It will nevertheless be necessary for the brake force to exist. It should be clear that the cord windings can only be tightened to engage the inner sleeve 16, if the first and second cord ends 44,46 are capable of moving relative to one another. Brake pad 48 thus delays the first cord end 44, if the second cord end 46 is moved with the outer sleeve 22.

Figure 5:
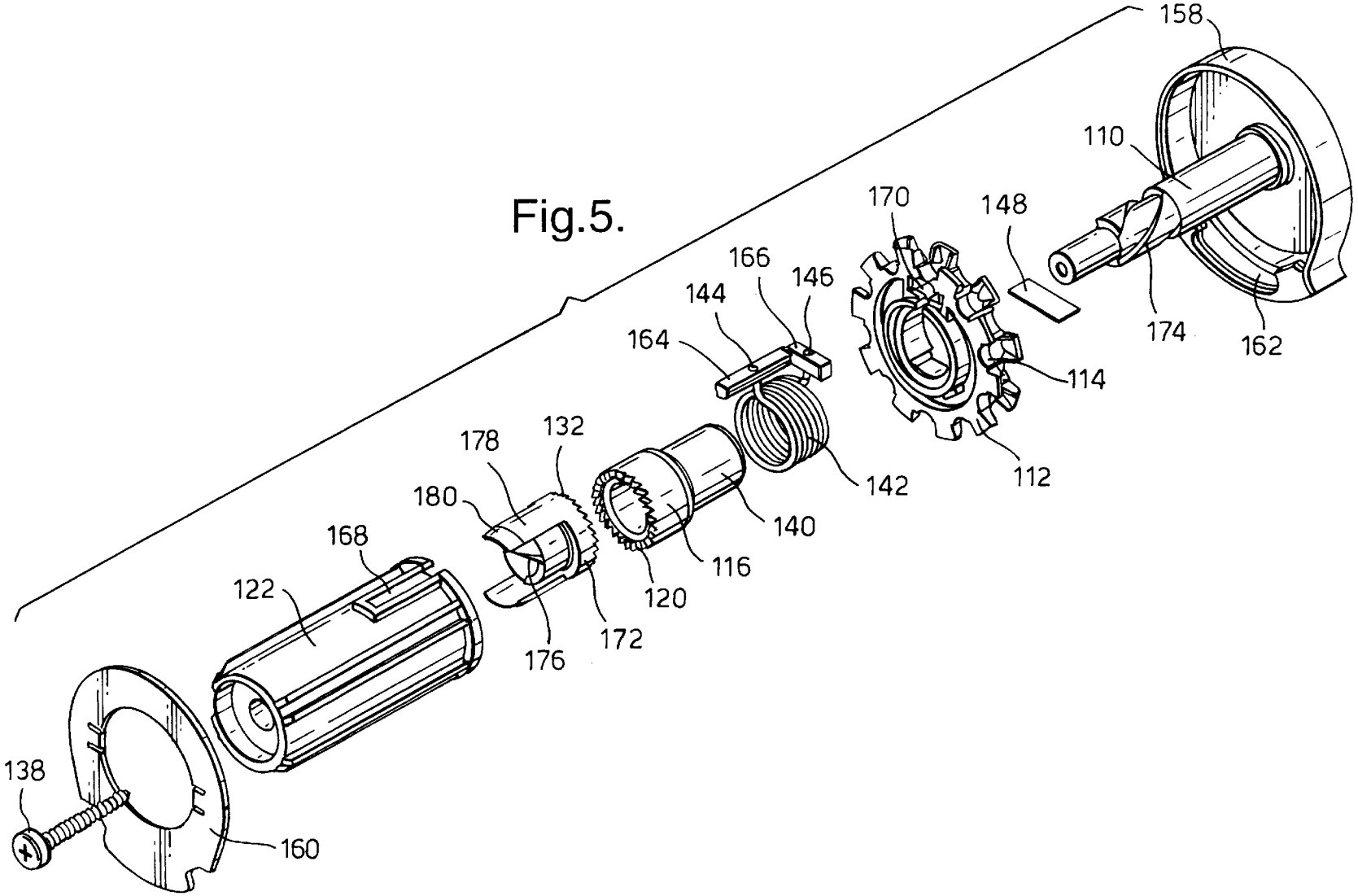
FIG. 5 is an exploded perspective view of another embodiment of a winding and unwinding mechanism according to the invention.
Figure 7:
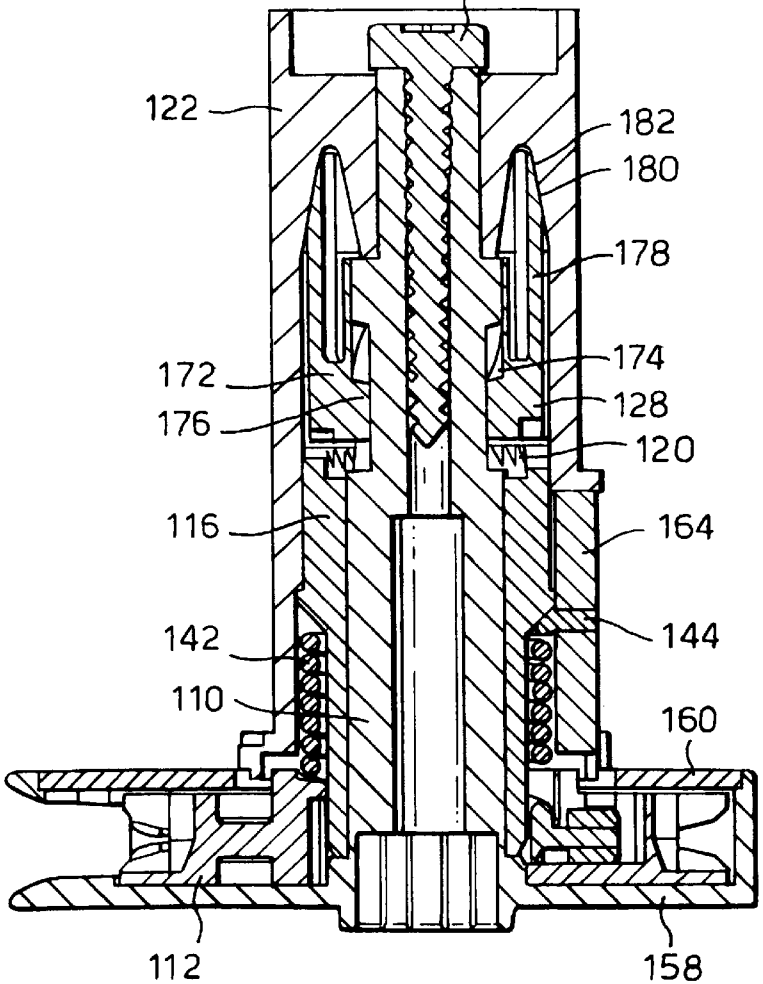
FIGS. 6 and 7 are longitudinal cross-sections of the assembled mechanism of FIG. 5 respectively at rest or during the unwinding operation and during the winding operation.
Figure 6:
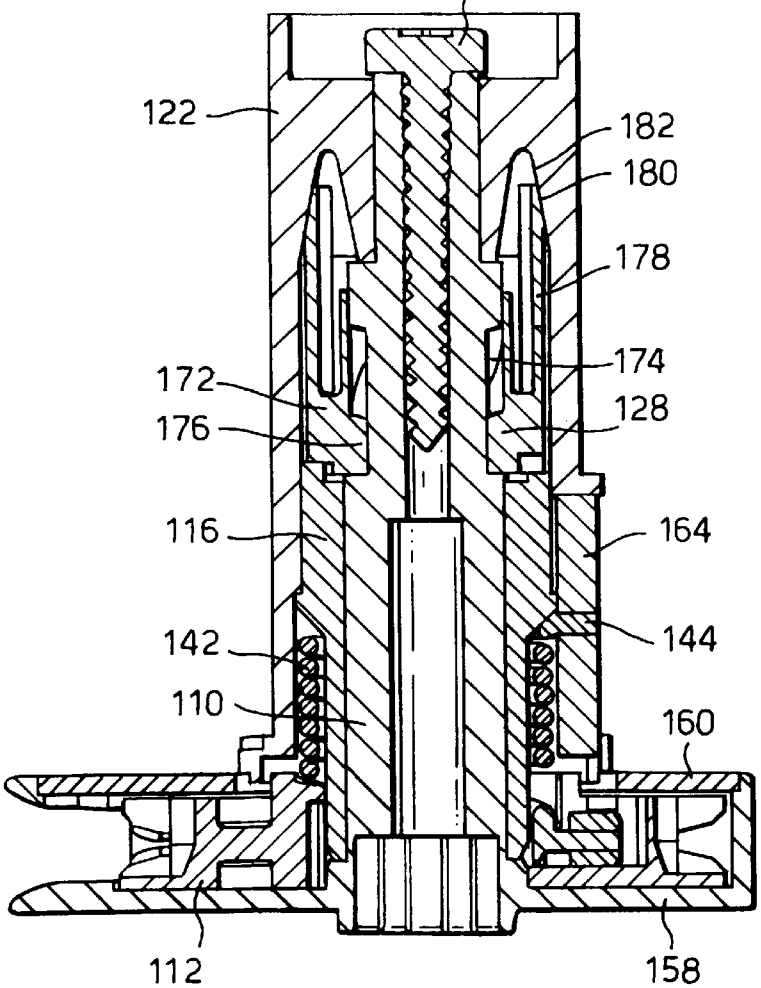

FIGS. 5 to 7 illustrate an alternative embodiment of the winding and unwinding mechanism of the invention which is similar to the mechanism of FIGS. 1 to 4 and for which corresponding reference numerals (greater by 100) are used below for describing the corresponding parts.

In this alternative embodiment, the fixed shaft 110 is attached to or integrally formed with a housing 158. As illustrated in FIGS. 6 and 7, the drive member or wheel 112 rotates within the housing 158 and the housing 158 is completed by means of a plate 160. Furthermore, an aperture 162 is provided in the periphery of the housing 158 to allow access for a bead chain or, in the case of using a pulley, for a cord.

The embodiment of FIG. 5 also includes blocks 164 and 166 secured respectively to the first and second ends 144, 146 of the cord 142. Block 164 slides into and is secured by slot 168 in the outer sleeve 122. Similarly, block 166 is fitted into opening 170 of the wheel 112.

As will be appreciated, the features discussed above for the embodiment of FIGS. 5 to 7 can also be used in conjunction with the embodiment of FIGS. 1 to 4.

The principle difference between the embodiment of FIG. 5 and the embodiment of FIGS. 1 to 4 resides in the construction of an alternative clutch member 172 in conjunction with the fixed shaft 110.

As illustrated in FIG. 5, the fixed shaft 110 is provided with a helical groove arrangement 174 rather than the keys 130 of FIG. 1. The clutch member 172 is provided internally with appropriate means for mating with the helical groove arrangement 174 and, in the figures, this comprises a corresponding helical thread 176. Thus, upon relative rotation between the clutch member 172 and the fixed shaft 110, the clutch member 172 is caused to move axially away from the inner sleeve 116, i.e. left as illustrated in FIG. 5. In this respect, it should be appreciated that any suitable mating thread arrangement can be used between the clutch member 172 and the fixed shaft 110 to achieve this effect.

In operation, the clutch member 172 works as follows.

With a blind at rest, the weight of the blind provides a rotational force or torque on the outer sleeve 122 in the anti-clockwise direction as illustrated in FIG. 5. This force is transmitted via the block 164 and first end 144 of the cord 142 to tighten the cord 142 onto the outer surface 140 of the inner sleeve 116. At this time, as illustrated in FIG. 6, the teeth 120 of the inner sleeve 116 mate with the teeth 132 of the clutch member 172, with the clutch member 172 at the base (right hand end in FIG. 5) of the helical groove arrangement 174. Hence, the rotational force is transmitted from the outer sleeve 122 to the inner sleeve 116 and, via the teeth 120 and 132 to the clutch member 172. In this position, the clutch member 172 is unable to rotate, since further rotation will cause it to press against the base of the helical groove arrangement 174 or at least press harder against the teeth 120 of the inner sleeve 116 which is itself constrained from axial movement. Thus, the blind is unable to rotate the outer sleeve 122 under its own weight.

Upon rotating the wheel 112 to raise the blind, the rotation of the wheel 112 (clockwise as illustrated in FIG. 5) is transmitted via the block 166 and second end 146 of the cord 142 so as to tighten and grip the outer surface 140 of the inner sleeve 116 and, furthermore, via the first end 144 of the cord 142 and the block 164, rotate the outer sleeve 122.

Of course, the inner sleeve 116 at this time is engaged with the clutch member 172 by means of the teeth 120 and 132. However, as described above, rotation of the clutch member 172 in a clockwise direction (as illustrated in FIG. 5) results in axial movement of the clutch member 172 away from the inner sleeve 116. In this way, the clutch member 172 disengages its teeth 132 from the teeth 120 of the inner sleeve 116 as illustrated in FIG. 7 and allows free rotation of the inner sleeve 116 and, hence, also, the wheel 112 and outer sleeve 122 raising the blind.

This arrangement is advantageous over that of the first embodiment in that the teeth 120 and 132 do not have to move against each other during the operation of winding up a blind. This avoids any "clicking" sound during the winding operation and also reduces wear between the teeth 120,132.

It will be appreciated that in this embodiment, the clutch operation is achieved by separation of the clutch member 172 from the inner sleeve 116 rather than any ratchet profile of the teeth 120 and 132. Hence, for this embodiment, it is not necessary for the clutch member 172 and inner sleeve 116 to have ratchet teeth as such. Any appropriate mating surfaces can be used between the clutch member 172 and inner sleeve 116. However, those surfaces are preferably inclined in such a manner that, as the clutch member 172 moves rotationally and axially back towards the inner sleeve 116, the profile of the mating surfaces itself assists in guiding the clutch member 172 back into full engagement with the inner sleeve 116.

As will be seen from FIGS. 5 to 7, this embodiment is not provided with a spring 34 for axially biassing the clutch member 172. It would be possible to provide such a spring. However, this embodiment includes an advantageous alternative.

In particular, the clutch member 172 is provided with two resilient and axially extending tongues 178. The tongues 178 are at the periphery of the clutch member 172 and extend axially in the opposite direction to the teeth 32. At their ends, they are provided with generally conical end surfaces 180.

As illustrated in FIGS. 6 and 7, the outer sleeve 122 receives the clutch member 172 and has a generally conical inner surface 182 against which the end surfaces 180 of the tongues 178 abut.

With the mechanism stationary and the weight of the blind on the outer sleeve 122, as described previously with reference to FIG. 6, the clutch member 172 is engaged with the inner sleeve 116. The inner surface 182 of the outer sleeve 122 is arranged such that, in this position, the tongue 178 of the clutch member 172 are generally undeflected and there is at most only a light pressure between the end surfaces 180 of the tongues 178 and the inner generally conical surface 182. In this way, when the wheel 112 is rotated so as to lower the blind (anti-clockwise as illustrated in FIG. 5), rotation of the outer sleeve 122 will not be significantly affected by any friction between the end surfaces 180 of the tongue 178 and the inner generally conical surface 182. Any frictional force that does arise will tend to rotate the clutch member 172 on the helical arrangement 174,176 so as to move the end surfaces 180 away from the inner surface 182 and to move the teeth 132 into stronger engagement with the teeth 120.

When the wheel 112 is then rotated so as to raise the blind (clockwise as illustrated in FIG. 5) a discussed above, the clutch member 172 is moved axially away from the inner sleeve 116 to the position illustrated in FIG. 7. As illustrated in this figure, to accommodate this movement, the resilient tongues 178 are deflected inwardly by interaction of the end surfaces 180 and the inner surface 182. Due to the resulting frictional force between the end surfaces 180 and inner surface 182, rotation of the outer sleeve 122 winding up the blind will tend to rotate the clutch member 172. In this way, even after the teeth 132 have left engagement with the teeth 120, the clutch member 172 is rotated and, hence, kept axially away from the inner sleeve 116. Of course, the clutch member 172 only rotates sufficiently to move axially away from the inner sleeve 116 whereas the outer sleeve 122 continues to rotate so as to wind up the blind. Hence, although a significant frictional force arises between the end surfaces 180 of the tongue 178 and the generally conical inner surface 182 of the outer sleeve 122 relative rotational slip is allowed during the winding process.

As will be appreciated, as soon as the outer sleeve 122 starts once again to rotate under the weight of the blind (anti-clockwise as illustrated in FIG. 5), the frictional force between the end surfaces 180 and inner surface 182 will rotate the clutch member 172 bringing the teeth 132 back into engagement with the teeth 120 locking rotation of the inner sleeve 116 and hence also the outer sleeve 122.

Clearly, the described arrangement could operate with only one tongue 178. However, for balanced symmetric forces, it is preferred that the clutch member 172 has two or more symmetrically arranged tongues 178.

We claim:

1. A winding mechanism for an architectural covering, such as a blind or shade, said mechanism including a fixed, stationary shaft having an axis, an inner sleeve mounted for rotation relative to said stationary shaft about said axis, a one way clutch permitting relative rotation between said inner sleeve and said shaft about said axis in one rotation sense, but preventing rotation relative in the opposite sense, an outer sleeve mounted for rotation relative to said inner sleeve, said outer sleeve having a substantially cylindrical inner wall, and said inner sleeve having a substantially cylindrical outer surface, radially spaced from and extending within said inner wall by a given radial distance, a drive member rotatable relative to said stationary shaft, and a cord secured at a first end to said drive member, said cord being helically wrapped about said outer surface of said inner sleeve, within the outer sleeve, a second end of said cord being secured to said outer sleeve, the arrangement being such that the weight of the blind or shade which in use tends to rotate the outer sleeve in said one rotational sense, thereby causing the cord to tighten on the outer surface of the inner sleeve, and locking said outer sleeve to said inner sleeve, and preventing rotation of said outer sleeve in said opposite rotational sense.

2. A mechanism according to claim 1, wherein said given radial distance by which the inner wall of the outer sleeve is radially spaced from the outer surface of the inner sleeve corresponds to an amount only slightly in excess of the thickness of the cord.

3. A mechanism according to claim 2, wherein a friction brake is provided to restrain rotational movement between said drive member and said fixed shaft.

4. A mechanism according to claim 3, wherein said one way clutch is provided by ratchet teeth on an end of said inner sleeve and on a clutch member surrounding said fixed shaft and spring urged so that the ratchet teeth of the clutch member engage the ratchet teeth of the inner sleeve.

5. A mechanism according to claim 3 wherein said one way clutch comprises a clutch member surrounding said fixed shaft and having a mating surface for mating with an end of said inner sleeve to prevent relative rotation therebetween, the clutch member being mounted on said fixed shaft with a mating helical thread arrangement such that rotation of the clutch member in the winding direction causes axial movement of the clutch member to disengage said mating surface from the end of said inner sleeve.

6. A mechanism according to claim 5 wherein the clutch member includes at least one axially extending resilient tongue with a generally conical end surface and wherein the outer sleeve includes an inwardly facing generally conical surface against which said end surface abuts such that, when the clutch member is axially moved to disengage said mating surface, the end surface is moved axially and radially inwardly by the conical surface against the resilient resistance of the tongue so as to form a frictional force therebetween, the frictional force enabling the outer sleeve to rotate the clutch member.

7. A mechanism according to claim 1, wherein a friction brake is provided to restrain rotational movement between said drive member and said fixed shaft.

8. A mechanism according to claim 7, wherein said one way clutch is provided by ratchet teeth on an end of said inner sleeve and on a clutch member surrounding said fixed shaft and spring urged so that the ratchet teeth of the clutch member engage the ratchet teeth of the inner sleeve.

9. A mechanism according to claim 7 wherein said one way clutch comprises a clutch member surrounding said fixed shaft and having a mating surface for mating with an end of said inner sleeve to prevent relative rotation therebetween, the clutch member being mounted on said fixed shaft with a mating helical thread arrangement such that rotation of the clutch member in the winding direction causes axial movement of the clutch member to disengage said mating surface from the end of said inner sleeve.

10. A mechanism according to claim 9 wherein the clutch member includes at least one axially extending resilient tongue with a generally conical end surface and wherein the outer sleeve includes an inwardly facing generally conical surface against which said end surface abuts such that, when the clutch member is axially moved to disengage said mating surface, the end surface is moved axially and radially inwardly by the conical surface against the resilient resistance of the tongue so as to form a frictional force therebetween, the frictional force enabling the outer sleeve to rotate the clutch member.

11. A mechanism according to claim 2, wherein said one way clutch is provided by ratchet teeth on an end of said inner sleeve and on a clutch member surrounding said fixed shaft and spring urged so that the ratchet teeth of the clutch member engage the ratchet teeth of the inner sleeve.

12. A mechanism according to claim 2 wherein said one way clutch comprises a clutch member surrounding said fixed shaft and having a mating surface for mating with an end of said inner sleeve to prevent relative rotation therebetween, the clutch member being mounted on said fixed shaft with a mating helical thread arrangement such that rotation of the clutch member in the winding direction causes axial movement of the clutch member to disengage said mating surface from the end of said inner sleeve.

13. A mechanism according to claim 12 wherein the clutch member includes at least one axially extending resilient tongue with a generally conical end surface and wherein the outer sleeve includes an inwardly facing generally conical surface against which said end surface abuts such that, when the clutch member is axially moved to disengage said mating surface, the end surface is moved axially and radially inwardly by the conical surface against the resilient resistance of the tongue so as to form a frictional force therebetween, the frictional force enabling the outer sleeve to rotate the clutch member.

14. A mechanism according to claim 1, wherein said one way clutch is provided by ratchet teeth on an end of said inner sleeve and on a clutch member surrounding said fixed shaft and spring urged so that the ratchet teeth of the clutch member engage the ratchet teeth of the inner sleeve.

15. A mechanism according to claim 1 wherein said one say clutch comprises a clutch member surrounding said fixed shaft and having a mating surface for mating with an end of said inner sleeve to prevent relative rotation therebetween, the clutch member being mounted on said fixed shaft with a mating helical thread arrangement such that rotation of the clutch member in the winding direction causes axial movement of the clutch member to disengage said mating surface from the end of said inner sleeve.

16. A mechanism according to claim 15 wherein the clutch member includes at least one axially extending resilient tongue with a generally conical end surface and wherein the outer sleeve includes an inwardly facing generally conical surface against which said end surface abuts such that, when the clutch member is axially moved to disengage said mating surface, the end surface is moved axially and radially inwardly by the conical surface against the resilient resistance of the tongue so as to form a frictional force therebetween, the frictional force enabling the outer sleeve to rotate the clutch member.

* * * * *